United States Patent [19]

Suprunov

[11] 4,247,087

[45] Jan. 27, 1981

[54] FURNACE INSTALLATION FOR THE PYROMETALLURGICAL TREATMENT OF FINE-GRAINED ORE CONCENTRATES

[75] Inventor: Vladimir Suprunov, Cologne, Fed. Rep. of Germany

[73] Assignee: Klöckner-Humboldt-Deutz AG, Fed. Rep. of Germany

[21] Appl. No.: 35,689

[22] Filed: May 3, 1979

Related U.S. Application Data

[63] Continuation of Ser. No. 827,547, Aug. 25, 1977, abandoned.

[30] Foreign Application Priority Data

Aug. 25, 1976 [DE] Fed. Rep. of Germany ..... 2638132

[51] Int. Cl.[3] ..... C21C 1/00

[52] U.S. Cl. ..... 266/212; 75/10 R; 75/74

[58] Field of Search ..... 266/162, 164, 172, 212; 75/10 R, 74

[56] References Cited

U.S. PATENT DOCUMENTS

| | | | |
|---|---|---|---|
| 2,668,107 | 2/1954 | Gordon | 75/74 |
| 2,850,372 | 9/1958 | Planiol | 266/172 |
| 3,271,134 | 9/1966 | Derham | 266/172 |
| 3,460,817 | 8/1969 | Brittingham | 266/164 |
| 3,555,164 | 1/1971 | Kostin | 75/10 R |
| 3,752,663 | 8/1973 | Worner | 266/162 |
| 4,027,863 | 6/1977 | Aaltonen | 266/190 |

FOREIGN PATENT DOCUMENTS

| | | | |
|---|---|---|---|
| 2038227 | 11/1972 | Fed. Rep. of Germany | 266/172 |

*Primary Examiner*—P. D. Rosenberg

*Attorney, Agent, or Firm*—Hill, Van Santen, Steadman, Chiara & Simpson

[57] ABSTRACT

A furnace assembly for the pyrometallurgical treatment of fine-grained ore concentrates including a housing in which there is located a reactor for reacting an ore concentrate and an oxygen-rich gas admitted thereto, the housing further having means therein defining a collection chamber for collection of the molten metal and a settling hearth in the housing communicating with the collection chamber. The housing is provided with a downwardly offset wall means in the roof thereof and partition means in dependent relationship with such offset wall means. The partition means are positioned to isolate the upper portion of the collection chamber from the settling hearth. An exhaust stack is provided transversely with respect to the long dimension of the settling hearth.

4 Claims, 4 Drawing Figures

FURNACE INSTALLATION FOR THE PYROMETALLURGICAL TREATMENT OF FINE-GRAINED ORE CONCENTRATES

This is a continuation of application Ser. No. 827,547, filed Aug. 25, 1977, now abandoned.

The invention relates to a furnace installation for the pyrometallurgical treatment of finely grained ore concentrates with a suspension-smelt-reactor, into which the input material is introduced together with an oxygen-rich gas and during the suspension, calcined or sintered and melted, with an exhaust-gas-shaft for the withdrawal of gas and dust and with a collection chamber serving for the collection of the melt, said collection chamber being communicatingly connected under a separating wall or partition being immersed vertically from above in the melting or molten bath, with a settling-hearth for the further treatment of the melt and removal of the slag, whereby the melt-collection-chamber and the settling hearth are arranged in a common housing.

In such a known pyrometallurgical furnace-installation (German Laid Out Specification No. 2,038,227), finely grained sulfidic ore concentrate is blown in with a stream of oxygen into a suspension-smelt-reactor and there, while it is in the suspension condition, continually calcined or sintered and melted. With a sufficiently high sulfide-sulfur-content, through the calcination of the sulfide-sulfur, so much heat is produced, that the calcining- or sintering- and melting-operation progress autogenously. Underneath the smelting device, the gas formed as well as dust, is separated from the melt, and drawn off through an exhaust-gas-shaft, while the melt is collected in a collection chamber, where a primary slag forms. This chamber is separated by means of a partition immersing from above in the melting or molten bath from a further chamber, which is connected communicatingly under the partition with the first chamber, so that the surface of the melting or molten bath is equally high in both chambers. This second chamber, an electro-resistance-heated settling hearth, serves for the reduction of the melt, for example by means of introduced coke-fines or -dust, and for the gravimetric separation of metal and the secondary slags forming, which are drawn off from the settling hearth. Melting device and settling hearth are arranged in a common housing and are separated from one another solely by means of the partition or separating wall, respectively, immersing in the melt or slag, respectively, said separating wall preventing a mixture of gases of the oxidation- and the reduction-zone.

The furnace wall parts coming in contact with the melt or slag, respectively, must absolutely be cooled, particularly the partition between both communicating chambers, because this partition is subjected on both sides to the hot metal- or slag-bath, respectively, as well as aggressive gases. Therefore, the partition consists of a hollow metal plate with channels, which are flowed through by cool water. This cooled partition, whose production is expensive, however, leads or carries off from both chambers of the furnace installation with the cooling water, a considerable quantity of heat, which must be covered by an increased supply of energy to the furnace installation.

The problem serving as basis for the invention is to improve a pyrometallurgical furnace installation with suspension-melt-reactor and settling hearth, which are positioned in a common housing with intermediary partition, so that the heat losses, and thereupon the specific uses of energy and therewith the operational costs as well as also the investment costs are decreased.

This problem is solved with a furnace installation of the type mentioned at the beginning, in accordance with the invention, thereby, that the coiling wall of the common furnace housing in the area of the partition between the two connected chambers communicating with one another projects downwardly in direction to the housing floor and that the partition extends downward from the projection of the housing cooling-wall.

Through the construction according to the invention, the height of the cooled partition immersing from above in the melt- or slag-bath, respectively, between melt-aggregate and settling hearth, and therewith, the effective cooling surface are held as low as possible. This has as a result the advantage that both from the melt-aggregate and melt-collection-chamber, as well as also from the settling-tanks, as little heat loss as possible flows off outward over the partition, so that the specific energy use with the melt-aggregate of the additional fuel supplied, if need be, to the inserted material or to the melt-reactor itself, respectively, and with the settling hearth to the hot stream supplied to the electrothermal reduction furnace, may be held small. The autogenity-limit of the endothermic melting operation is lowered, that is, that the calcining- and melting-operation progresses autogenously, instead of at for example 20% of sulfide-sulfur-content of the inserted concentrate, already for example at about 17% sulfide-sulfur-content,—which has as a result, that through the construction in accordance with the invention, an ore concentrate lower in sulfide-sulfur or other oxidizable constituent, respectively, may be melted autogenously and that with lower contents in such oxidizable constituents, the necessary requirement of addition-fuel (coal-dust or heating-coke, oil, gas) may be held correspondingly lower, whereby also the necessary requirement of oxygen for the combustion of the addition-fuel is lowered. Through the construction according to the invention, the investment costs are also decreased, mainly for the reason, because the expensive hollow intermediary partition of the furnace provided with cooling water and consisting for example of copper, is comparably small, and because the electrothermal settling hearth, on account of its lower specific energy- or current-requirement, respectively, requires less electrodes.

The invention and its further advantages, will be explained in greater detail on the basis of the embodiments by way of example shown diagrammatically in the Figures.

Figure 1:
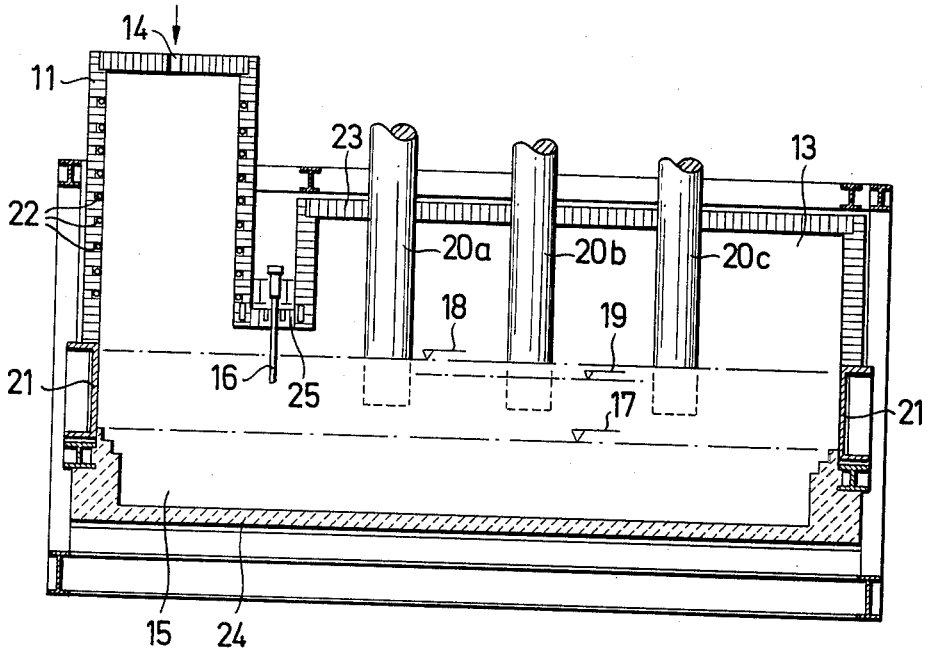
FIG. 1 shows a vertical section through the furnace installation, along line I—I of FIG. 2.
Figure 2:
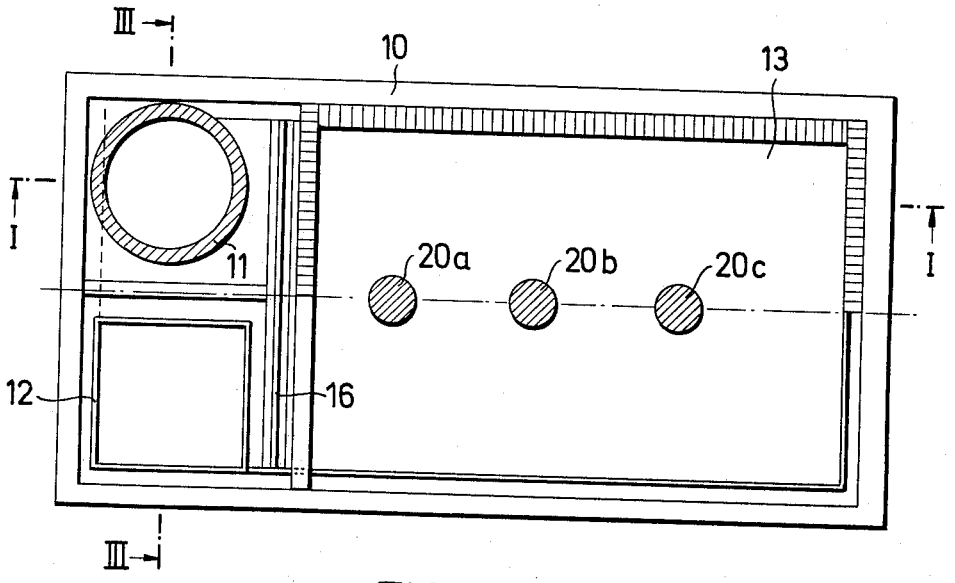
FIG. 2 shows a horizontal section through the furnace installation of FIG. 1.
Figure 3:
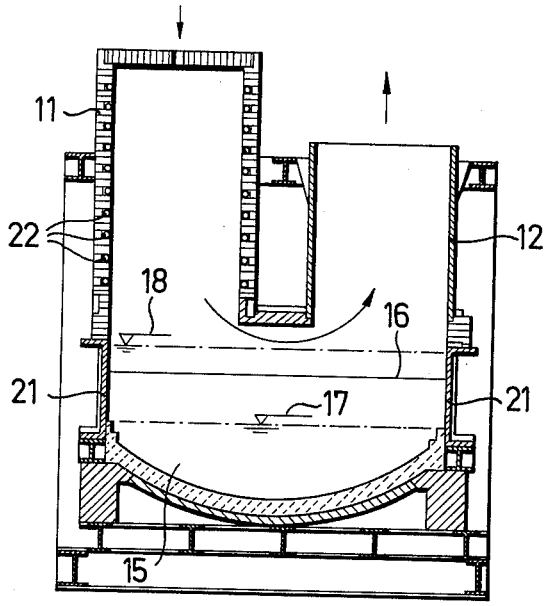
FIG. 3 shows a section along line III—III of FIG. 2.

According to FIGS. 1 to 3, the pyrometallurgical furnace installation in accordance with the invention, which is to serve for the melting of fine-grained sulfidic lead-ore-concentrate, has a common housing 10, in which a suspension-melting reactor 11, an exhaust-gas-shaft 12 and a settling hearth heated with electro-resistance, are arranged. The suspension-melting-reactor 11 is a vertical melting shaft, in which is blown in through the opening 14, from above, the sulfidic ore concentrate with a stream of technically pure oxygen. Instead of the vertical smelting shaft, a smelting cyclone could also be provided. The concentrate, upon momentary heating to a high temperature in fractions of seconds, while still in suspension condition, is calcined and melted.

The combustion of the sulfide-sulfur and if need be other oxidizable constituents delivers into the oxygen atmosphere mainly already sufficient heat in order to permit the calcining- and melting-operation to progress autogenously. Out of the melting shaft 11 flow droplets of melt and gas to a melt-collection chamber 15 arranged therebelow, above which the melt is separated from the exhaust gas. The exhaust gas is drawn off together with dust formed, upwardly, through the exhaust-gas-shaft 12. In the collection chamber 15 forms on the collected melt, a primary slag. The melt flows under the lower edge of a vertical, water-cooled partition 16 immersing from above in the melting- or molten-bath or slag-bath, respectively,—into the settling hearth 13. In the settling hearth 13, the melt is reduced by means of introduced coke-fines and it obtains the opportunity to separate itself into lead and forming of secondary slags, which are pushed out separately from the settling hearth.

As the chambers on both sides of the partition 16 are connected communicatingly with one another, or siphon-like, respectively, the melting bath surface or the slag-bath surface is equally high in both chambers. Thus, the level of lead bath is indicated by the line 17, while the maximum slag-bath-level is indicated by the line 18, and the minimal slag-bath-level by the line 19. The cooled partition 16 prevents the mixing of gases of the oxidation- and reduction-zone, and makes it possible that in both of these zones, an atmosphere may be maintained independently of one another. In the melting- or slag-bath, respectively, of the electrothermal settling hearth 13, from above, three electrodes 20*a*, 20*b* and 20*c* are immersed. Those wall parts of the furnace installation which come in contact with the slag-bath are provided with water-cooled cooling-beams 21 provided with cooling channels, for example, copper plates. The bricked up walls of the melting shaft 11 are cooled by means of cooling channels 22.

In accordance with the invention, the ceiling wall 23 of the common furnace housing 10, in the area of the separating wall or partition 16 between the two chambers connected communicatingly with one another, project downwardly in direction to the housing floor 24. From this projection 25 of this housing ceiling wall 23, the partition 16 extends so far downward that it is immersed with its lower edge in the melting- or slag-bath, respectively. The cooled partition 16 is therefore only very short and accordingly the cooling surface as small as possible, whereby lower heat losses and therewith lower specific uses of energy both in the melting aggregate 11 as well as also in the settling hearth 13 result, compared with a pyrometallurgical furnace installation with the same data as to output, melting-shaft-diameter, melting bath surface, melting bath height and the like, which the constructive features according to the invention do not have. In the furnace installation according to the invention, the surface is held as low as possible in metallic cooling plates; the specific heat-flow-through (for example in kcal/m$^2$ per hour) through cooling plates is namely 70% greater than through bricked up cooled walls.

In the common furnace housing 10, there are arranged on one side of the partition 16 of the melting shaft 11 and beside it transversely to the longitudinal extent of the settling hearth 13 the exhaust-gas-shaft 12. The melting shaft and the exhaust-gas-shaft are accordingly separated from one another by two walls remote from one another with spacing. The vertical melting shaft 11 has advantageously an ideal round cross-section.

Figure 4:
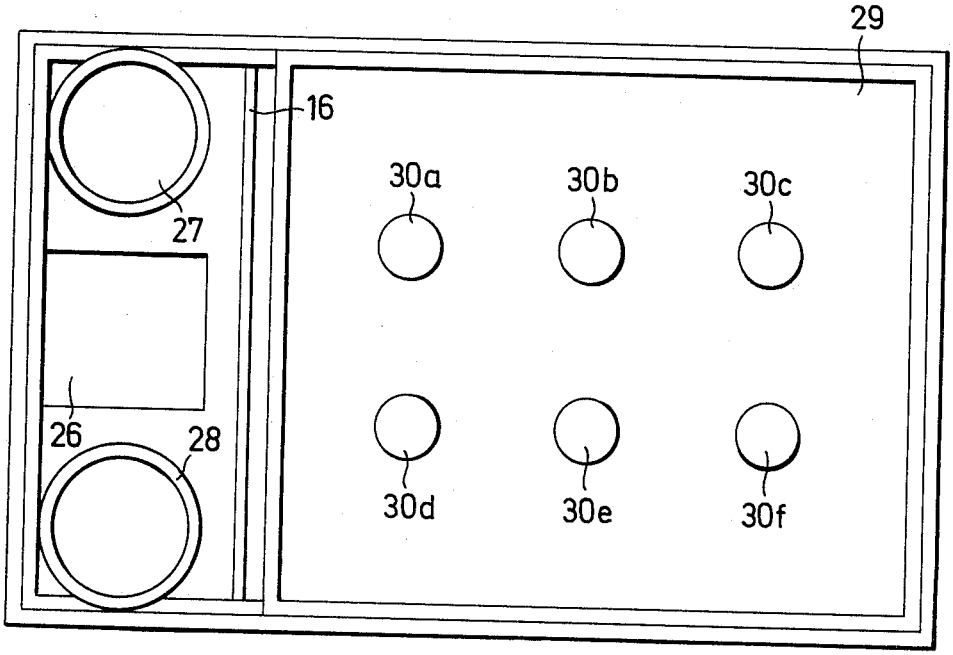
FIG. 4 shows the plan view of another embodiment of the furnace installation, according to the invention.

FIG. 4 shows in plan view a twin-furnace-installation, in which according to the invention, on both sides of a central, common exhaust-gas-shaft 26, each a melting shaft 27 and 28 is attached, and below the two melting shafts, a common melt-collection-chamber is arranged, which under the partition 16 immersing in the melting bath is communicatingly connected with a common settling hearth 29, which is equipped with six electrodes 30*a* to 30*f*.

In the Table added in the enclosure, the specific uses of energy, namely, supplied electroenergy to the settling hearth and combustion coke and oxygen supplied to the melting shaft of the furnace installation, in accordance with the invention, with the corresponding values of the furnace installation known from the German Laid Out Specification No. 2,038,227, are compared with one another, at the same furnace data as to melting bath surface, melting bath height, melting shaft diameter and so forth, and indeed as variation I for a two-line installation with two times 80,000 annual tons of raw lead production and as variation II for a single-line furnace installation corresponding to FIG. 4, with at once 160,000 annual tons of raw lead production. According to this Table, the following appreciable savings in the pyrometallurgical furnace installation result, compared with the known furnace installation.

| | Variation I<br>2 × 80,000 annual tons raw lead | Variation II<br>1 × 160,000 annual tons raw lead |
|---|---|---|
| Savings: | | |
| Electroenergy | 10.5% | 20.6% |
| Heating coke | 100% | 100% |
| Oxygen | 6% | 6% |
| Investment costs | 13% | no indications |

TABLE

TABELLE

| Verbrauch | Use | Variation I / Variante I: Jahrestonnen-Rohblei / Annual tons--raw lead, 2 × 80.000/2 Linien / lines: German Laid Out Specification DT-AS 2038227 | Konstruktion / Construction: Invention Erfindung | Konstruktion / Construction: Difference Differenz | Variation II / Variante II: Jahrestonnen-Rohblei / Annual tons--raw lead, 1 × 160.000/1 Linie / line: DI-AS 2038227 | Construction: Invention Erfindung | Construction: Difference Differenz | Remarks Bemerkungen Referred to lead carrier |
|---|---|---|---|---|---|---|---|---|
| Electroenergy Elektroenergie | | | | | | | | in inserted concentrate |
| spez. spec. | KWh/t° | 502 | 449 | 53 | 437 | 347 | 90 | t° = bezogen aur |
| jahrlich anually | KWh/a × $10^6$ | 128 | 114,5 | 13,5 | 111,1 | 88,5 | 22,6 | Bleitrager im Einsatzkonzentrat |
| | DM/a × $10^6$ | 7,7 | 6,9 | 0,8 | 6,7 | 5,3 | 1,4 | DM 0,06/KWh |
| Combustion coke Verbrennungskoks | | | none | | | | | |
| spez. | kg/t° | 6,5 | keine | 6,5 | 6,5 | keine | 6,5 | |
| jahrlich | kg/a × $10^6$ | 1,7 | " | 1,7 | 1,7 | " | 1,7 | DM 270,-/t |
| " | DM/a × $10^6$ | 0,5 | " | 0,5 | 0,5 | " | 0,5 | |
| Sauerstoff Oxygen | | | | | | | | |
| spez. | kg/t | 274,9 | 258,4 | 16,5 | 274,9 | 258,4 | 16,1 | Oxygen |
| jahrlich | kg/a × $10^6$ | 69.9 | 65,9 | 4,0 | 69,9 | 65,9 | 4,0 | Dm 0,25/kg Sauerstoff |
| " | DM/a × $10^6$ | 1,7 | 1,6 | 0,1 | 1,7 | 1,6 | 0,1 | |
| Operational savings Setriebsersparnis | DM/a × $10^6$ | | | 1,4 | | | 2,0 | |
| Summe sum | | | | | | | | |
| Investment costs Investitionskosten | DM/a × $10^6$ | 18,5 | 16,1 | 2,4 | no indications keine Angaben | | | |

I claim:

1. A furnace assembly for the pyrometallurgical treatment of fine-grained ore concentrates comprising:

a housing having a roof and a relatively long longitudinal dimension, a melting shaft in said housing, means for introducing suspended particles of ore concentrate and an oxygen-rich gas into said melting shaft, means in said housing defining a collection chamber for collecting material melted in said melting shaft, a settling hearth in said housing in free communication with said collection chamber, a downwardly offset wall means in said roof of said housing terminating short of the melt contained in said furnace, vertical partition means depending from said offset wall means and positioned to isolate the upper portion of said collection chamber from said settling hearth, said partition means being sufficiently long to be partly immersed in the melt in said furnace, an exhaust gas shaft positioned adjacent said melting shaft, the axis of said shaft and the axis of said melting shaft lying in a common vertical plane which is perpendicular to the centerline of said longitudinal dimension, said exhaust gas shaft and said melting shaft lying on opposite sides of said centerline, vertical wall means positioned along said centerline perpendicular to said vertical partition means, and means for cooling said partition means.

2. A furnace assembly according to claim 1, in which said reactor has a circular cross section.

3. A furnace assembly according to claim 1 which includes a plurality of electrodes positioned within said settling hearth.

4. A furnace assembly according to claim 1 which includes cooling means surrounding said melting shaft.

* * * * *